US005351931A

United States Patent [19]

Houben et al.

[11] Patent Number: 5,351,931

[45] Date of Patent: Oct. 4, 1994

[54] PAPER-MAKING KIT WITH IMPROVED BASIN AND WEB SUPPORTING SCREEN

[76] Inventors: Teresa Houben, Apt. 2, 31 King Street East, Bowmanville, Ontario, Canada, L1C 1N1; Mary Houben, Box 164; Trudy Van Dyk, Box 151, both of Strathroy, Ontario, Canada, N7G 3J2

[21] Appl. No.: 39,597

[22] Filed: Mar. 23, 1993

[51] Int. Cl.[5] ..... D21F 13/02; D21J 7/00

[52] U.S. Cl. ..... 249/141; 162/382; 162/386; 220/571; 425/84; 425/86

[58] Field of Search ..... 249/113, 141; 264/86; 425/84, 86; 162/382, 386; 206/501, 503; 220/571, 572, 573, 676

[56] References Cited

U.S. PATENT DOCUMENTS

| | | | |
|---|---|---|---|
| 1,471,169 | 10/1923 | Kaye | 249/141 |
| 3,674,396 | 7/1972 | McCormick | 425/84 |
| 4,014,739 | 3/1977 | Granberg | 425/84 |

FOREIGN PATENT DOCUMENTS

| | | | |
|---|---|---|---|
| 1511185 | 5/1978 | United Kingdom | 162/386 |

*Primary Examiner*—James Mackey

[57] ABSTRACT

A paper making apparatus is adapted to receive a mixture of liquid and paper fiber on a fiber retaining screen surface operable to drain excess water from the fiber and through the screen, during the formation of a discrete fiber web on the surface. The improvement herein comprises a basin which defines confines for normally retaining the liquids thereby received therein, and has a bottom with generally upwardly extending side walls including a generally horizontally extending ledge adapted to receive the screen in supported relation thereon. The ledge is generally surrounded by a screen positioning wall for locatingly positioning the screen in supported relation on the ledge in draining register above the confines of the basin. The screen positioning wall includes an at least one longitudinally extending opening therein adapted to provide generally open lateral access for grasping an adjacent screen edge in aid of the removal thereof from its supported relation on the basin. The opening is subtended by an adjacent and generally longitudinally coextensive depression in the ledge, which depression and opening are co-operable for controllably directing the draining of collected liquids from within the confines of the basin, upon tipping of the basin towards the opening.

8 Claims, 3 Drawing Sheets

PAPER-MAKING KIT WITH IMPROVED BASIN AND WEB SUPPORTING SCREEN

FIELD OF THE INVENTION

The present invention relates to a paper making kit for educational and novelty purposes, comprising apparatus adapted to receive a mixture of liquid and paper fiber on a fiber retaining screen surface that is operable to drain excess water from the fiber into a screen supporting basin, while forming a discrete fiber web on that screen surface.

BACKGROUND OF THE INVENTION

Paper-making kits conveniently provide an educational insight into the making of paper. They are also both educational and novelty items, especially in environmentally concerned (i.e. recycling-conscious) cultures.

Various kits for making sheets of paper are generally known in art. In accordance with the present invention, however, there is provided apparatus adapted to facilitate the registration of the screen in supported relation over the basin, but which also facilitate the subsequent removal of the screen from the supporting basin and too, the draining of any liquids retained therein.

SUMMARY OF THE INVENTION

In accordance with one aspect of the present invention, there is provided a basin adapted to co-operably receive a screen in supported superposition thereon.

The basin defines confines for normally retaining liquids received therein, and comprises a bottom with generally upwardly extending side walls. The side walls include a generally horizontally extending ledge adapted to receive the screen in supported relation thereon.

The ledge itself is generally surrounded by a screen positioning wall adapted for locatingly positioning the screen in supported relation on the ledge, in draining register above the confines of the basin. That screen positioning wall also includes an at least one longitudinally-extending opening therein, which is adapted to provide generally open lateral access for grasping an adjacent screen edge in aid of the removal thereof from its abovementioned supported relation.

The opening is subtended by an adjacent and generally longitudinally-coextensive depression formed in the ledge, which depression and opening are thereby cooperable for controllably directing the draining of collected liquids from within the confines of the basin, upon tilting of the basin to cause its contents to flow towards the opening. This facilitates ease of cleanup and is an important in educational settings where student to teacher ratios are high, and the educator's time is either not available or not well spent in supervising individual student handling of the basin.

Typically, the basin comprises a shallow basin with contiguously formed side walls that extend upwardly and slightly outwardly from the bottom. The side walls extend so to a generally transverse ledge which in turn extends outwardly beyond the side walls, to an intersection with a generally upwardly extending screen positioning wall. Preferably, the screen positioning wall has at least two openings therein, which are arranged along mutually opposed ends of the basin.

Preferably the depression comprises an upwardly and outwardly angled, inclined plane which extends from its lowermost extent, (which is located at least substantially below the side walls uppermost extent), to a spaced apart extent thereof that is below and outward of a proximally adjacent intersection between the ledge and the screen positioning wall.

It is also preferred that the side walls comprise two pairs of mutually opposed ones of side walls arranged in a generally rectangular array about the periphery of the bottom. Ideally, the corner intersections between adjacent ones of these side walls and the bottom are three-way radiused corners.

In an especially preferred form, the screen positioning wall includes a downwardly and outwardly inclined peripheral wall surface extending from a rounded apex formed along a junction between an inwardly facing screen positioning surface of the screen positioning wall and the inclined peripheral wall surface.

The present invention also extends to combinations of a basin and a cooperatively super-positionable screen, wherein the basin defines confines for normally retaining liquids received therein. As before the basin comprises a bottom with generally upwardly extending side walls including a generally horizontally extending ledge adapted to receive the screen in supported relation thereon. The ledge is generally surrounded by a screen positioning wall for locatingly positioning the screen in supported relation on the ledge, so that it is oriented thereon in draining register above the confines of the basin. The screen positioning wall includes an at least one longitudinally-extending opening therein, which is adapted to provide generally open lateral access for grasping an adjacent screen edge in aid of the removal thereof from the aforementioned supported relation. Each at least on opening is preferably subtended by a respective at least one adjacent and generally longitudinally-coextensive depression in the ledge. The depression and the respective opening are co-operable for controllably directing the draining of collected liquids from within the confines of the basin, in the manner elsewhere described.

The screen comprises a mesh, and preferably is one that is supported around its periphery by a rigid frame that is adapted to hold the mesh under tension. The mesh is preferably made of metal or plastic materials, with the former preferably being a rust resistant metal, while the latter is preferably a plastic that resists deformation, especially both elastic and non-elastic longitudinal extension. A conventional rectangular window screen construction is particularly preferred.

The forgoing is preferably arranged as part of a kit including the apparatus and sundry materials suited to making paper, and in any case at a minimum including instructions therefor, setting out the steps necessary to the acquisition and any pretreatment of materials needed to make a paper web using the apparatus herein described.

More particularly, the present invention relates to a paper making apparatus adapted to receive a mixture of liquid and paper fiber on a fiber retaining screen surface that is operable to drain excess water from the fiber and through the screen, during the formation of a discrete fiber web on the surface. For the purposes of these presents, a "discrete" fiber web is one having length and width dimensions of equal to or less than the screen surface. "Discrete" in this sense can be thought of as distinguishing from the "continuous" webs that are typically associated with industrial paper making equipment. In any case, the improvement herein comprises a basin which defines confines for normally retaining the liquids thereby received therein, and has a bottom with generally upwardly extending side walls including a generally horizontally extending ledge adapted to receive the screen in supported relation thereon. Here again, the ledge is generally surrounded by a screen positioning wall for locatingly positioning the screen in supported relation on the ledge in draining register above the confines of the basin. The screen positioning wall includes an at least one longitudinally-extending opening therein adapted to provide generally open lateral access for grasping an adjacent screen edge in aid of the removal thereof from its supported relation on the basin. The opening is subtended by an adjacent and generally longitudinally-coextensive depression in the ledge, which depression and opening are co-operable for directing the draining of collected liquids from within the confines of the basin, upon tipping of the basin towards the opening.

DETAILED DESCRIPTION OF A PREFERRED EMBODIMENT

Introduction to the Drawings

Figure 1:
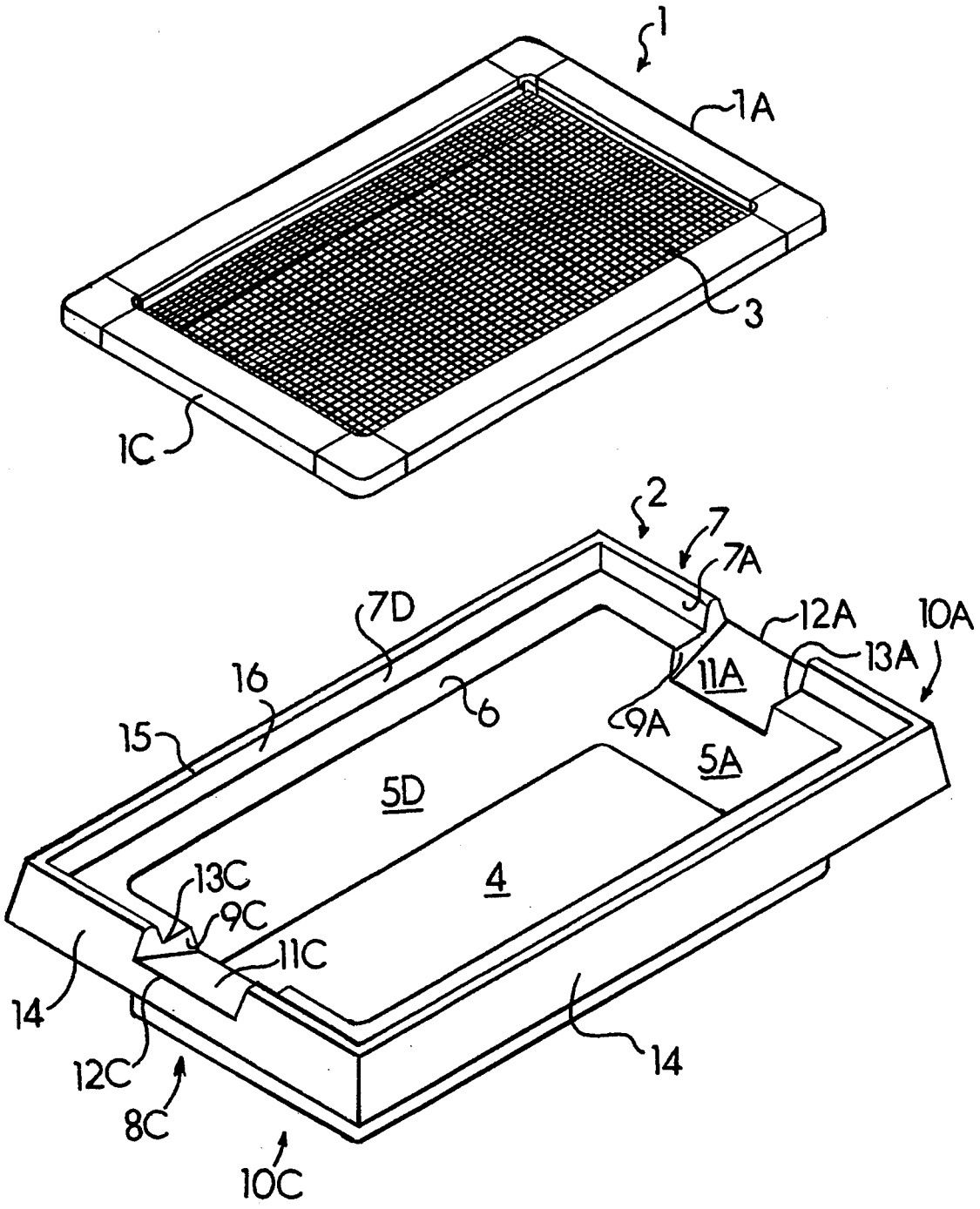
FIG. 1 is an exploded perspective view of a preferred screen and basin combination in accordance with the present invention, that are parts of a paper making kit.
Figure 2:
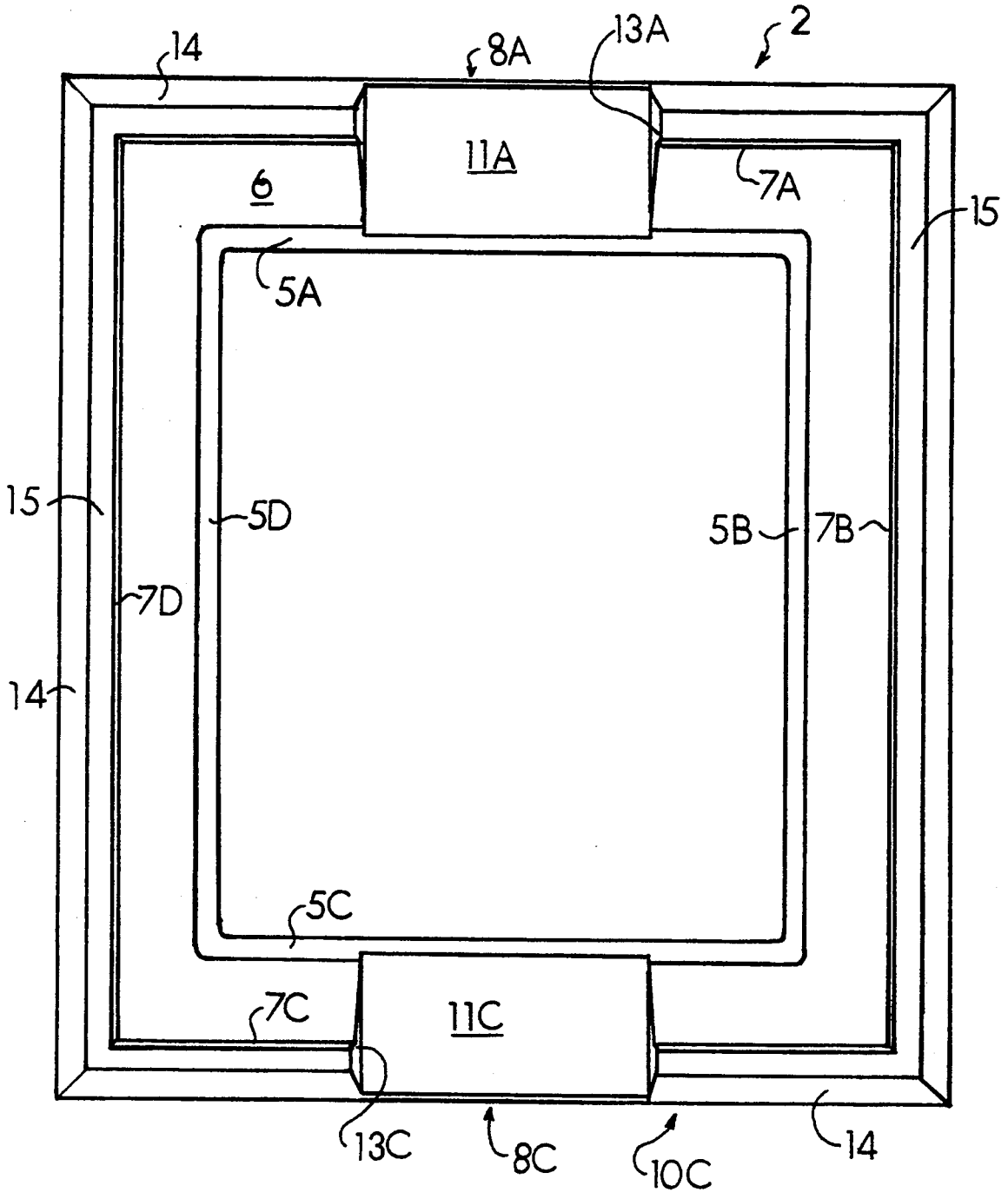
FIG. 2 is a top plan view of the basin illustrated in FIG. 1.
Figure 3:
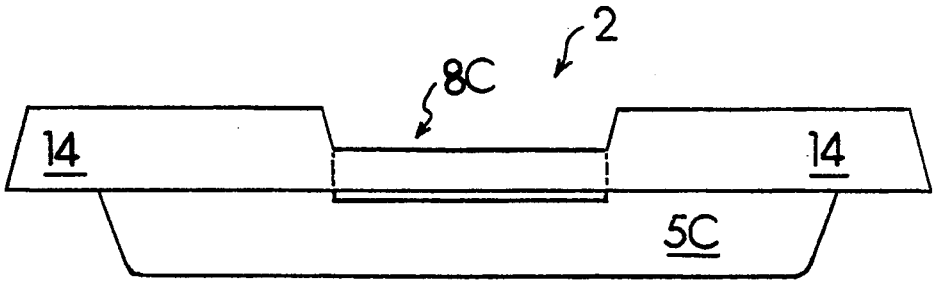
FIG. 3 is an elevated end view of the basin shown in FIGS. 1 and 2; and, FIG. 4 is an elevated side view of the basin depicted in the other FIGURES appended hereto.
Figure 4:
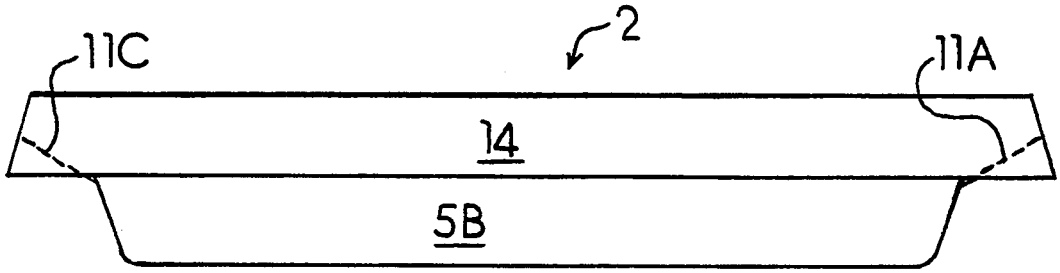

In accordance with a preferred embodiment according to the present invention, and referring to the drawings in general, there is provided a paper making kit, including, inter alia, apparatus adapted to receive a mixture of liquid and paper fiber on a fiber retaining screen 1 having a surface 3, that is operable to drain excess water from said fiber, through screen and into a supporting basin 2, during the formation of a discrete fiber web on the screen surface 3.

The apparatus includes an improvements to the basin 2, which defines the confines that normally retain the screened liquids received therein. The basin 2 has a bottom 4 with generally upwardly extending side walls 5*a*, 5*b*, 5*c*, and 5*d*, which further include a generally horizontally extending ledge 6. Ledge 6 is adapted to receive screen 1 in supported relation thereon. Ledge 6 is generally surrounded by a screen positioning wall 7 comprised of a contiguously serial arrangement of walls 7*a*, 7*b*, 7*c*, and 7*d*. The screen positioning wall is operable for locatingly positioning screen 1 in supported relation on ledge 6, so that it is held in draining register above the confines of basin 2. Screen positioning wall 7 includes two longitudinally-extending openings 8*a* and 8*c* in walls 7*a* and 7*c* thereof, that are adapted to provide generally open lateral access. The openings 8*a* and 8*c*, are operable to afford the access required for grasping adjacent screen edges 1*a* and 1*c* respectively, adjacent openings along walls 7*a* and 7*c*. This aids of the removal of screen 1 from its supported relation on ledge 6. The openings 8*a* and 8*c*, are subtended by respective ones of adjacent and generally longitudinally-coextensive depressions 9*a* and 9*c*, in the ledge 6. These depressions, 9*a* and 9*c*, the corresponding openings 8*a* and 8*c*, are thereby co-operably arranged for controllably directing the draining of collected liquids from within the confines of basin 2. This is accomplished in operation, by tilting of basin 2 towards one or the other of openings 8*a* or 8*c*.

As illustrated, basin 2 preferably comprises a shallow basin in which the contiguously formed side walls 5*a* through 5*d*, extend upwardly and slightly outwardly from bottom 4 towards the generally transversely arranged ledge 6. Ledge 6, in turn, extends outwardly beyond the side walls 5*a* through 5*d*, to meet the generally upwardly extending screen positioning wall 7 having openings 8*a* and 8*c* therein arranged along walls 7*a* and 7*c* that are located at mutually opposed ends 10*a* and 10*c* of basin 2.

The depressions 9*a* and 9*c* each comprise upwardly and outwardly angled inclined planes 11*a* and 11*c*, respectively. Each of these planes extend from its lowermost extent located at least substantially below the corresponding uppermost extent's of side walls, 5*a* and 5*c* respectively, to an extent 12*a* and 12*c* that is below and outward of an adjacent intersection 13*a* and 13*c*, between the adjacent portions of ledge 6 and the adjacent screen positioning wall 7*a* and 7*c* respectively.

The side walls 5*a* through 5*d*, collectively comprise two pairs (5*a* and 5*c*; and 5*b* and 5*d*) of mutually opposed ones of side walls arranged in a generally rectangular array about the periphery of the bottom 4.

The corners defined at intersections between adjacent ones of side walls 5*a* through 5*d* and bottom 4 are preferably three-way radiused corners, sloping upwardly from bottom 4, and inwardly from adjacent ones of intersecting side walls.

The screen positioning wall 7 includes downwardly and outwardly inclined peripheral wall surfaces 14, that extend from a rounded apex 15 formed along a junction between inwardly and downwardly inclined screen positioning surfaces 16 of screen positioning wall 7 and the outwardly inclined peripheral wall surfaces 14.

In operation, screen 1 is located in superposed, supported relation on ledge 6, where it is arranged in draining register within the confines of walls 7*a* through 7*d*. Paper fiber material is then admixed with water, preferably in accordance with instructions accompanying the kit. In any case the water/fiber mixture is applied to screen surface 3, and the excess liquid drains through the screen 1, to be collected in basin 2. The screen 1 and the fiber mat formed thereon (not shown in the drawings), can be removed, leaving behind basin 2 and the screened water that it contains. In the course of its removal, the screen is readily grasped along edges 1*a* and 1*c* thereof, by way of the access provided through openings 8*a* and 8*c*. Subsequently, the water contained in basin 2, can be controllably drained therefrom by tilting basin 2 towards one or the other of the openings 8*a* or 8*c*. On such tilting, the water in basin 2 passes up the inclined plane 11*a* or 11*c* as the case may be, in respective ones of depressions 9*a* or 9*c*, and exits the confines of basin 2 through one or the other of openings 8*a* or 8*c*, (depending on the direction in which the basin is tilted).

We claim:

1. In a paper making apparatus adapted to receive a mixture of liquid and paper fiber on a fiber retaining screen surface operable to drain excess water from said fiber, through said screen, during the formation of a discrete fiber web on said surface, wherein the improvement comprises a basin defining confines for retaining liquids received therein, having a bottom with generally upwardly extending side walls including a generally horizontally extending ledge adapted to receive said screen in supported relation thereon, and wherein said ledge is generally surrounded by a screen positioning wall for locatingly positioning said screen in supported relation on said ledge in draining register above the confines of said basin, and wherein said screen positioning wall includes at least one longitudinally-extending opening therein adapted to provide generally open lateral access for grasping an adjacent screen edge in aid of the removal thereof from said supported relation, and wherein said opening is subtended by an adjacent and generally longitudinally-coextensive depression in said ledge, said depression and said opening being thereby co-operable for controllably directing the draining of collected liquids from within the confines of said basin, upon tilting of said basin towards said opening.

2. In combination, a basin and a cooperatively superpositionable screen, wherein said basin defines confines for retaining liquids received therein, and comprises a bottom with generally upwardly extending side walls including a generally horizontally extending ledge adapted to receive said screen in supported relation thereon, and wherein said ledge is generally surrounded by a screen positioning wall for locatingly positioning said screen in supported relation on said ledge in draining register above the confines of said basin, and wherein said screen positioning wall includes at least one longitudinally-extending opening thereon adapted to provide generally open lateral access for grasping an adjacent screen edge in aid of the removal thereof from said supported relation, and wherein said opening is subtended by an adjacent and generally longitudinally-coextensive depression in said ledge, said depression and said opening being thereby co-operable for controllably directing the draining of collected liquids from within the confines of said basin, upon tilting of said basin towards said opening.

3. A basin adapted to co-operably receive a screen in supporting superposition thereon, wherein said basin defines confines for retaining liquids received therein, and comprises a bottom with generally upwardly extending side walls including a generally horizontally extending ledge adapted to receive said screen in supported relation thereon, and wherein said ledge is generally surrounded by a screen positioning wall adapted for locatingly positioning said screen in supported relation on said ledge in draining register above the confines of said basin, and wherein said screen positioning wall includes at least one longitudinally-extending opening therein adapted to provide generally open lateral access for grasping an adjacent screen edge in aid of the removal thereof from said supported relation, and wherein said opening is subtended by an adjacent and generally longitudinally-coextensive depression in said ledge, said depression and said opening being thereby co-operable for controllably directing the draining of collected liquids from within the confines of said basin, upon tilting of

4. The basin according to claim 3, wherein said basin comprises a shallow basin in which said generally upwardly extending side walls are contiguously formed side walls that extend upwardly and slightly outwardly from said bottom to said generally horizontally extending ledge which extends transversly to said side walls, and outwardly beyond said side walls, to said screen positioning wall which comprises a generally upwardly extending screen positioning wall including a plurality of said openings therein arranged along mutually opposed ends of said basin.

5. The basin according to claim 4 wherein said depression comprises an upwardly and outwardly angled inclined plane which extends from a lowermost extent of said depression, located at least substantially below an uppermost extent of said side walls, to an extent that is below and outward of an adjacent intersection between said ledge and said screen positioning wall.

6. The basin according to claim 5 wherein said side walls include two pairs of mutually opposed ones of side walls arranged in a generally rectangular array about the periphery of the bottom.

7. The basin according to claim 6 wherein corners defined at intersections between adjacent ones of said side walls and said bottom are three-way radiused corners.

8. The basin according to claim 7, wherein the screen positioning wall includes a downwardly and outwardly inclined peripheral wall surface extending from a rounded apex formed along a junction between an inwardly facing screen positioning surface of said screen positioning wall and said inclined peripheral wall surface.

* * * * *